US005290212A

United States Patent [19]

Metcalf

[11] Patent Number: 5,290,212

[45] Date of Patent: Mar. 1, 1994

[54] EXERCISE CYCLE

[75] Inventor: Jeffrey D. Metcalf, Albion, Ill.

[73] Assignee: Roadmaster Corporation, Olney, Ill.

[21] Appl. No.: 754,063

[22] Filed: Sep. 3, 1991

[51] Int. Cl.[5] ..... A63B 22/12; A63B 69/16

[52] U.S. Cl. ..... 482/62; 482/111

[58] Field of Search ..... 482/53, 59, 62, 111, 482/148, 35-37, 70

[56] References Cited

U.S. PATENT DOCUMENTS

| | | | |
|---|---|---|---|
| 4,509,742 | 4/1985 | Cones | 482/62 |
| 4,589,656 | 5/1986 | Baldwin | 482/59 |
| 4,743,011 | 5/1988 | Coffey | 482/111 |
| 4,844,451 | 7/1989 | Bersonnet et al. | 482/62 |
| 4,852,872 | 0/1989 | Lo . | |
| 4,880,225 | 11/1989 | Lucas | 482/59 |
| 4,932,650 | 6/1990 | Bingham et al. | 482/59 |
| 5,048,824 | 9/1991 | Chen | 482/59 |
| 5,149,312 | 9/1992 | Croft et al. . | |

*Primary Examiner*—Stephen R. Crow

*Attorney, Agent, or Firm*—Polster, Lieder, Woodruff & Lucchesi

[57] ABSTRACT

An exercise cycle includes a frame having a front wheel assembly and handlebars. The front wheel assembly includes a fan wheel having side plates one of which has an intake port, and an intake assembly around the intake port, the intake assembly having openings which may be opened and closed. By opening and closing the intake openings, the resistance of the wheel to the air can be varied without changing the rotational rate of the wheel. The handlebars of the exercise cycle are pivotally connected to the cycle intermediate their ends. The lower ends of the handlebars are pivotally connected to a cam arm which is removably connected to the shaft to which the pedal is mounted. By connecting or disconnecting the cam arm to or from the pedal shaft, the handlebars can be selectively moved between a stationary mode and a mode in which the handlebars reciprocate between forward and backward positions.

15 Claims, 7 Drawing Sheets

EXERCISE CYCLE

BACKGROUND OF THE INVENTION

This invention relates to exercise equipment, and in particular, to an exercise cycle in which a fan wheel's resistance to air may be varied without varying the rotational speed of the wheel and in which the handlebars may readily be switched between a reciprocating mode and a stationary mode.

Exercise cycles benefit the user by improving cardiovascular fitness, enhancing body tone and engendering an overall sense of well being. Exercise cycles often include only one wheel mounted for rotation on a stand. The wheel often has vanes or paddles which increase the resistance to air and thus enhance the user's workout. Typically, to increase the wheel's air resistance, the user has to pedal faster. There is no convenient way to vary air resistance without varying the rotational rate of the wheel.

To exercise the upper body while using an exercise cycle, the handlebars of many exercise cycles are connected to the pedals so that they will reciprocate between a forward and a backward position. Other exercise cycles have only stationary handlebars. U.S. Pat. No. 4,844,451 to Bersonett et al. discloses an exercise cycle in which the handlebars can be switched between an immobile mode and a movable mode. In the movable mode, the exerciser pushes and pulls on the handlebars to move them. The handlebars are not connected to the pedals and the user must coordinate the pushing and pulling of his arms with the cycling motion of his legs. Applicant is aware of no exercise cycles in which the handlebars, which are operatively connected to the pedals, may easily be switched between a reciprocating mode and a stationary mode.

One object of the invention is to provide an exercise cycle in which the wheel's air resistance may be varied without the need to vary the rotational rate of the wheel.

Another object is to provide such an exercise cycle in which the handlebars may easily be switched between a reciprocating mode and a stationary mode.

These and other objects of this invention will be apparent to those skilled in the art in light of the following description and accompanying drawings.

SUMMARY OF THE INVENTION

In accordance with this invention, generally stated, there is provided an exercise cycle that includes a frame having a seat, handlebars, and a fork having two tines, an axle extending transversely of the tines, a wheel assembly mounted on the axle, a crankshaft assembly with pedals to operate the wheel assembly, and a mechanism to vary the air resistance of the wheel at a given rotational speed.

The wheel assembly includes a fan wheel rotatably mounted on the axle, a plate in the form of a generally imperforate disc with an axle receiving central opening, secured to one side of the fan wheel and a plate in the form of an annular ring with a central intake port, secured to the other side, and the resistance varying mechanism, which is supported by a tine opposite the disc.

The resistance varying mechanism includes a cowling defining at least one intake opening and a mechanism for varying the size of the intake opening The cowling is positioned adjacent the annular ring, to cover the intake port defined by the annular ring. In the preferred embodiment, the mechanism for varying the size of the intake opening includes a damper rotatably mounted on the cowling which has at least one solid area sufficiently large fully to close the intake opening and a mechanism for rotating the damper to move it between a fully open position and a fully closed position or any position between.

The ring has an inner edge having a first rib extending outboard there around and a second rib spaced from and concentric with the first rib. The cowling has spaced concentric ribs at its periphery defining a channel which receives the ring ribs. The interleaving of the ring ribs and the cover channel creates a labyrinth seal between the ring and the cover. The interleaving is close but there is sufficient tolerance between them so that the ring may rotate with the wheel without any interference from the cowling ribs.

The inner edge of the cowling defines a central opening and has a wall extending outwardly from the inner edge. A lip extends radially inwardly from the outer edge of the wall. The damper has spaced fingers arranged around a circle concentric with the center of the cover. The fingers have lips which engage the lip of the cowling to rotatably mount the damper to the cowling in a way to permit rotation of the damper with respect to the cowling.

The fan wheel includes a hub which is journaled on the axle to mount the fan wheel to the cycle. Vanes extend radially from the hub to space a narrow outer wheel from the hub. Fan paddles extend radially outwardly from the outer wheel, axially across the outer wheel.

Handlebar posts having handlebars at the tops thereof, are pivotally connected to a head tube at the front of the frame. The posts are mounted to the head tube at their approximate midpoints and can pivot between a forward position and a rearward position. The handlebars can selectively be changed from a mode in which the handlebars reciprocate between their forward and rearward positions and a mode in which the handlebars are stationary. A cam arm is pivotally connected at one end to the handlebar post beneath its pivot point and removably connected at another end to a pedal shaft. As the pedals are moved by an operator, the cam arm is moved forward and backward to move the handlebars between their forward and rearward positions. The cam arm has a notch or cutout which fits over the pedal shaft. The pedal shaft has a sponge rubber spring to hold the cam arm on the pedal shaft. When the operator does not want the handlebars to reciprocate, he removes the cam arm from the pedal shaft and places it on a holding shaft. The holding shaft also includes a sponge rubber spring to hold the cam arm thereon.

DESCRIPTION OF THE PREFERRED EMBODIMENT

Figure 1:
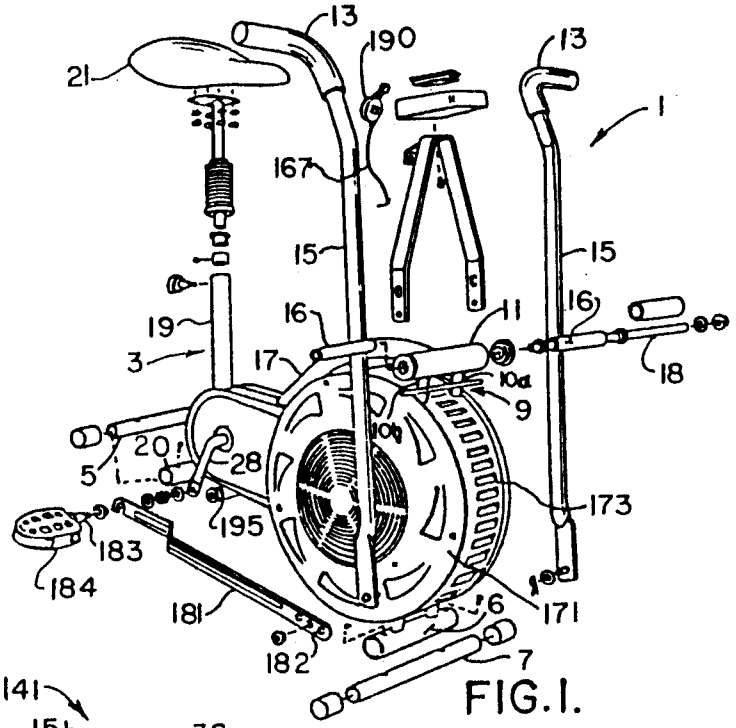
FIG. 1 is a perspective exploded view of an exercise cycle of the present invention.
Figure 2:
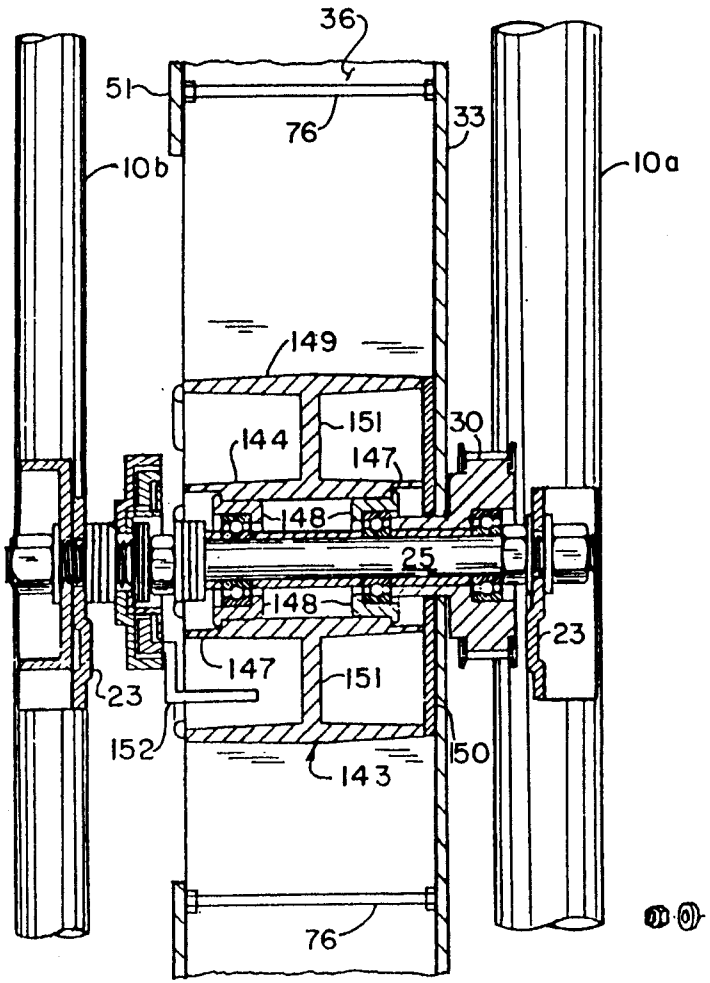
FIG. 2 is an enlarged fragmentary front elevational view, partly in cross-section, of the cycle with its intake assembly removed.

Referring to FIGS. 1 and 2, reference numeral 1 refers generally to an exercise cycle. Cycle 1 includes a frame 3 having a back foot 5 and a front foot 7. A fork 9 has tines 10*a* and 10*b* which are secured at their lower ends to and extend upwardly from a sleeve 6 which receives front foot 7. Foot 7 is secured in sleeve 6 by screws or the like. At their upper ends, the tines are secured to a head tube 11 that extends horizontally across the top of fork 9. Handlebars 13 are connected to handlebar posts 15.

Handlebar posts 15 have pivot tubes 16 welded transversely to them at their approximate mid-points. A pivot rod 18 extends through head tube 11 and pivot tubes 16 to pivotally attach handlebars 13 to frame 3. Handlebars 13 thus can pivot between a forward and a rearward position. As will be explained below, handlebars 13 can be switched between a mode in which they reciprocate between their forward and rearward positions, and a mode in which they are stationary.

An "S" shaped tube 17 is secured at a front end to head tube 11 and at its back end to a sleeve 20 which receives back foot 5 to join back foot 5 to head tube 11. A seat post 19 is secured to and extends up from tube 17 and has a seat 21 thereon. Mounting bars 23 are secured at one end to tines 10*a* and 10*b* and at another end to tube 17, and extend from a midpoint of tines 10*a* and 10*b* to tube 17. Bars 23 are generally horizontal and parallel. An axle 25 extends between bars 23 slightly rearwardly of tines 10*a* and 10*b* to rotatably secure a fan wheel 36 between the tines. A pedal assembly 27 is mounted between bars 23 slightly in front of seat post 19. Pedal assembly 27 includes a crank 28 connected to a sprocket assembly 29. Pedals 184 are rotatably connected to crank 28 by a shaft 183.

Figure 28:
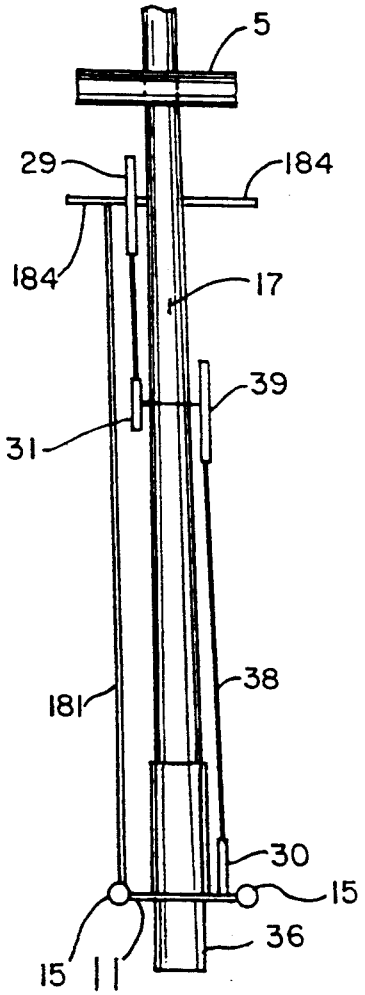
FIG. 28 is a somewhat diagrammatic view illustrating the various drive trains.
Figure 27:
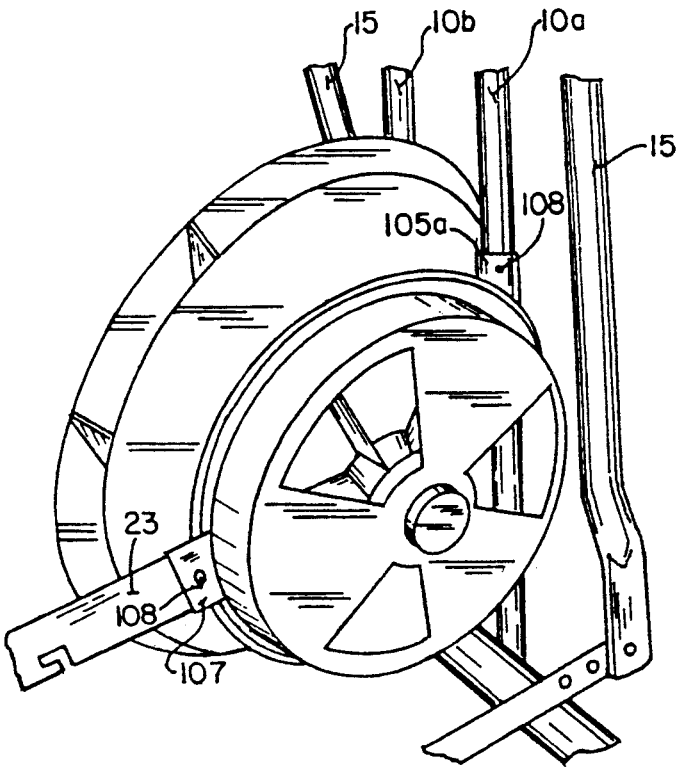
FIG. 27 is a fragmentary view in perspective showing the cowling assembly mounted on elements of the frame.

A wheel assembly 31 is rotatably mounted on axle 25 between fork tines 10*a* and 10*b*. Wheel assembly 31 includes a right attachment plate 33, fan wheel 36, a left attachment ring 51, and an intake assembly 35. Fan wheel 36 has a sheave 30 driven by a pulley belt 38. Pulley belt 38 is mounted on a second sheave 39 (see FIG. 28) which in turn is operatively connected, by way of sprocket 31, and a chain, to sprocket 29, so that wheel 36 may be operated by rotation of the crank 28. The second sprocket 31 is smaller than sprocket 29 and pulley 30 is smaller than pulley 38. This double sizing allows fan wheel 36 to be rotated faster with less vigorous pedaling on the part of the operator.

Plate 33 (FIGS. 6 and 7) includes a generally planar disc 37 with a hub opening 39 large enough to fit over the hub 144 of fan wheel 36. A plurality of ribs 41 extend radially from opening 39 to the outer edge of the disc 37. As shown, ribs 41 are formed in pairs. Plate 33 is secured to wheel 36, as is explained below, by bolts or the like which extend through bolt holes in the bottom of bolt-receiving wells 43 formed in disc 37. Bolt wells 43 include a generally hexagonal chamber 45 deep enough to receive a bolt receiving nut with an opening therein through which the bolt extends. The plate 33 is mounted over axle 25 on one side of wheel 36 so that ribs 41 and bolt chamber 45 face inwardly. A planar surface of plate 33 is thus exposed.

Figure 9:
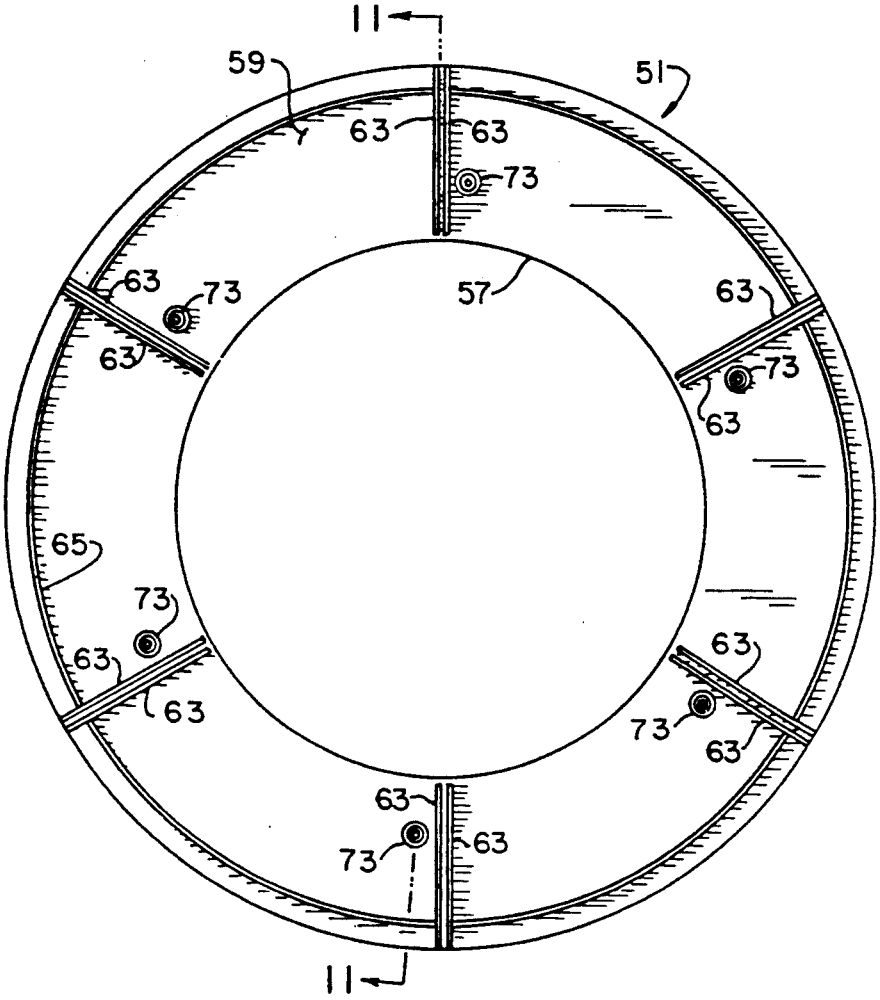
FIG. 9 is a front plan view of a right wheel attachment of the wheel assembly, in the same scale as FIG. 6.
Figure 11:
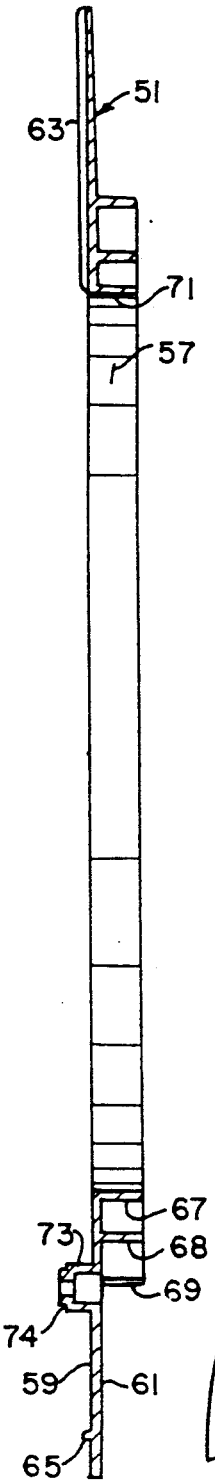
FIG. 11 is an enlarged, cross-sectional view of the right wheel attachment taken along line 11—11 of FIG. 9.
Figure 10:
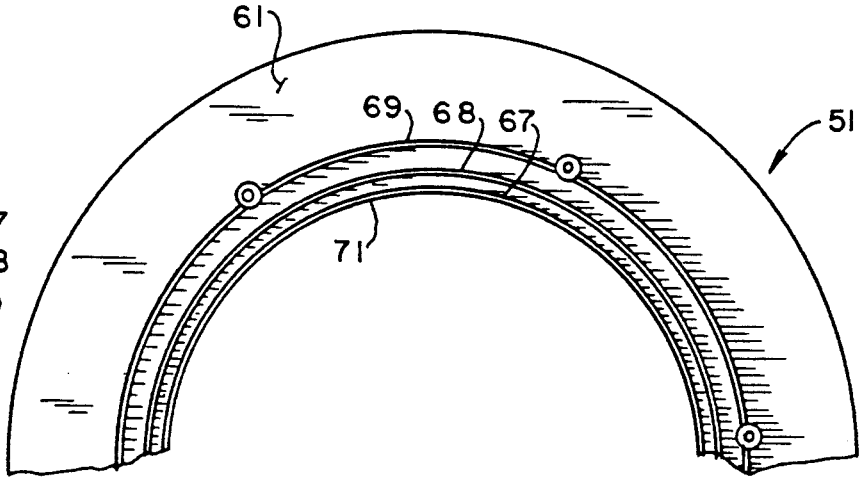
FIG. 10 is a fragmentary back plan view of the right wheel attachment.
Figure 14:
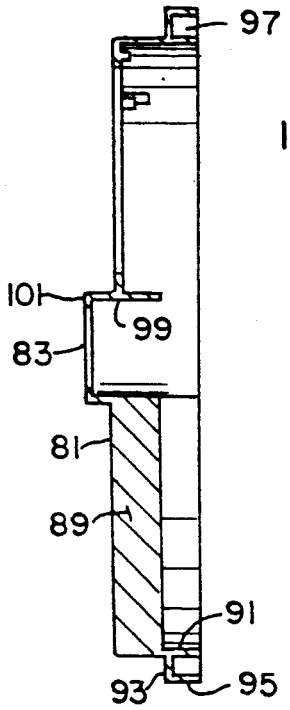
FIG. 14 is a cross-sectional view of the intake taken along line 14—14 of FIG. 12.
Figure 12:
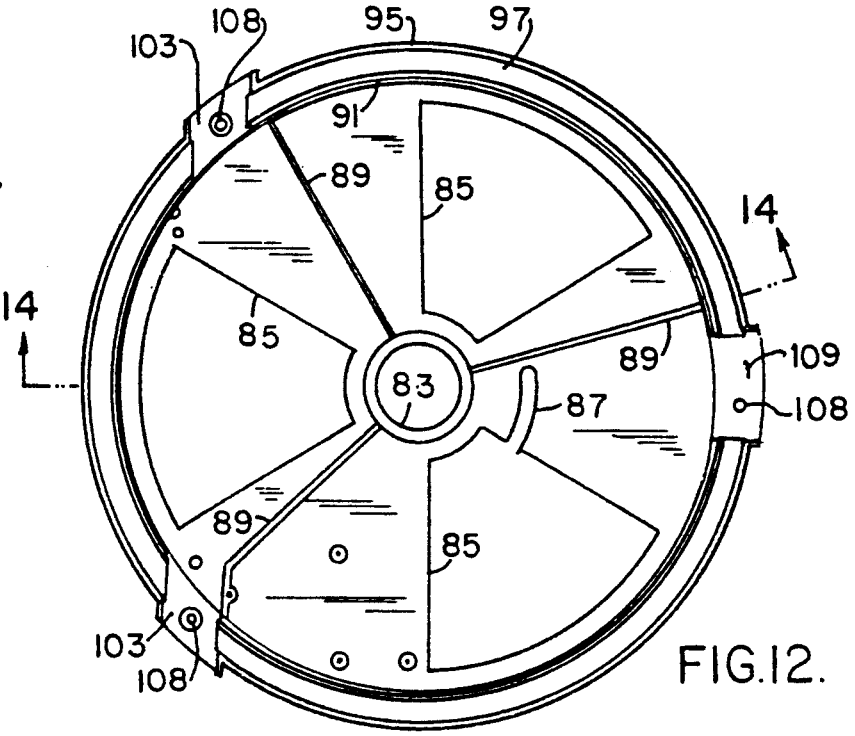
FIG. 12 is a bottom plan view of a intake of the fan wheel assembly, on the same scale as FIG. 6.
Figure 13:
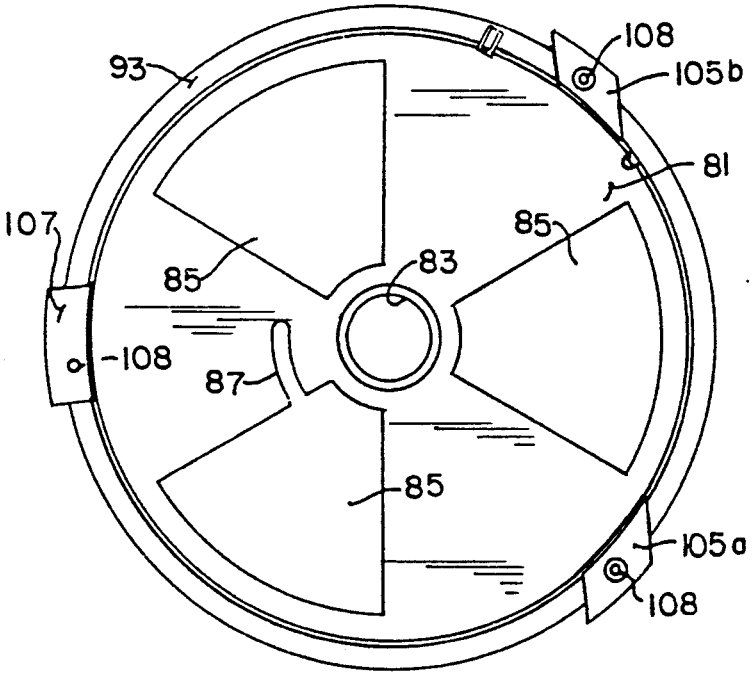
FIG. 13 is a top plan view of the intake.
Figure 16:
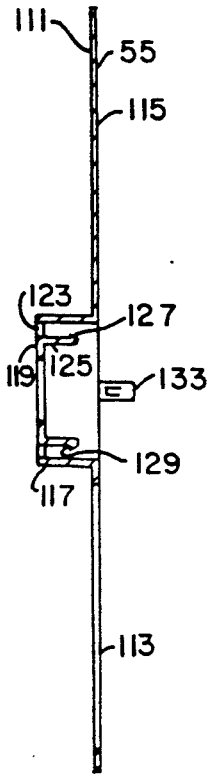
FIG. 16 is a cross-sectional view of the damper taken along line 16—16 of FIG. 15.
Figure 17:
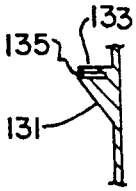
FIG. 17 is an enlarged, fragmentary cross-sectional view taken along line 17—17 of FIG. 15.
Figure 15:
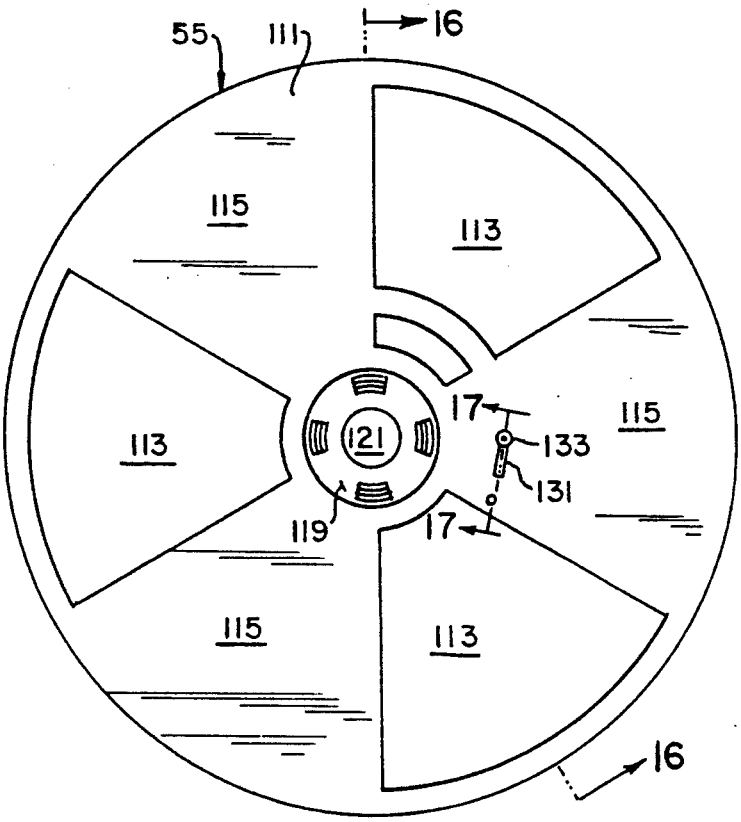
FIG. 15 is a bottom plan view of a damper of the intake assembly.
Figure 20:
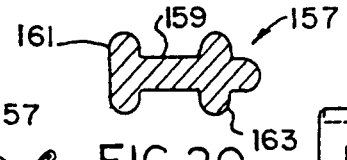
FIG. 20 is an enlarged cross-sectional view of a fan wheel rim taken along line 20—20 of FIG. 18.
Figure 18:
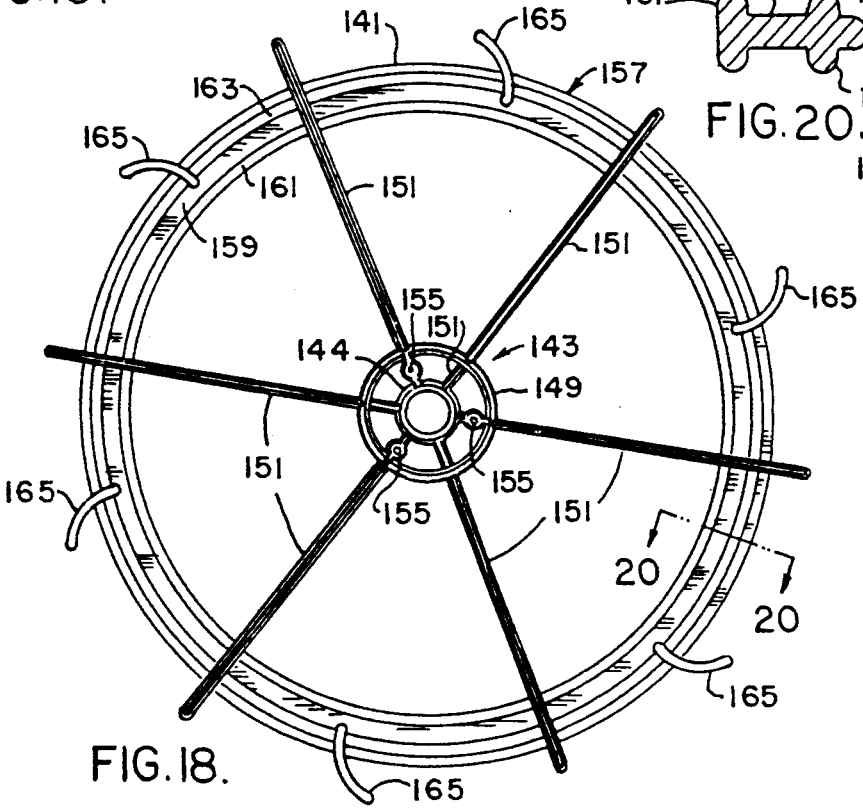
FIG. 18 is a side elevational view of a fan wheel of the wheel assembly.
Figure 19:
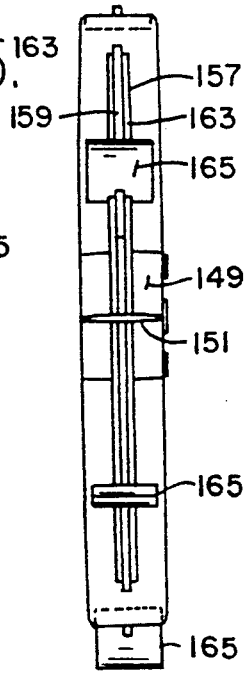
FIG. 19 is a front elevational view of the fan wheel.
Figure 23:
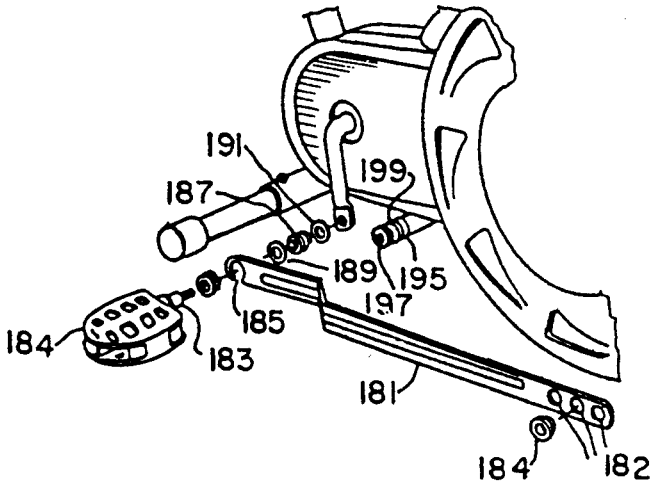
FIG. 23 is an exploded view of the cam arm pedal connection.
Figure 24:
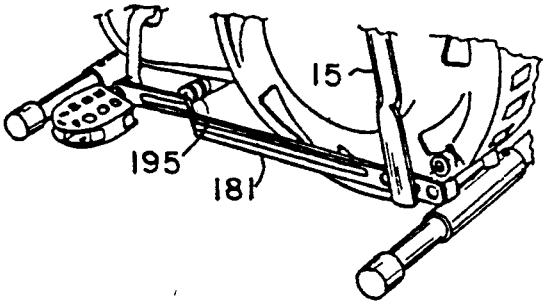
FIG. 24 is a perspective view of the cam arm connected to the pedal for reciprocal handlebar operation.
Figure 25:
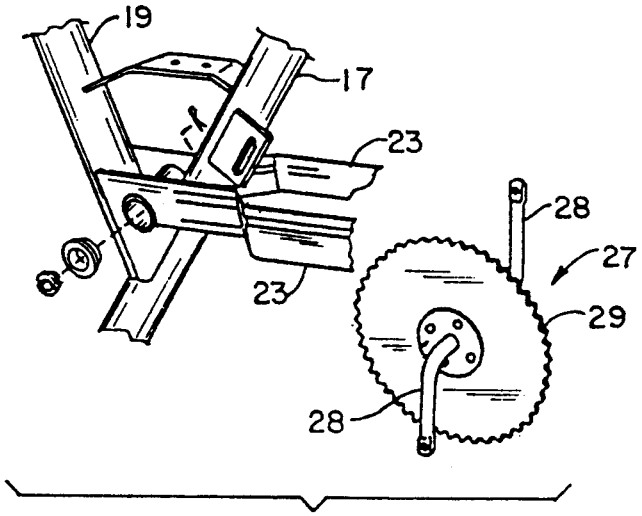
FIG. 25 is an enlarged, exploded fragmentary view of the pedal mounting assembly.
Figure 22:
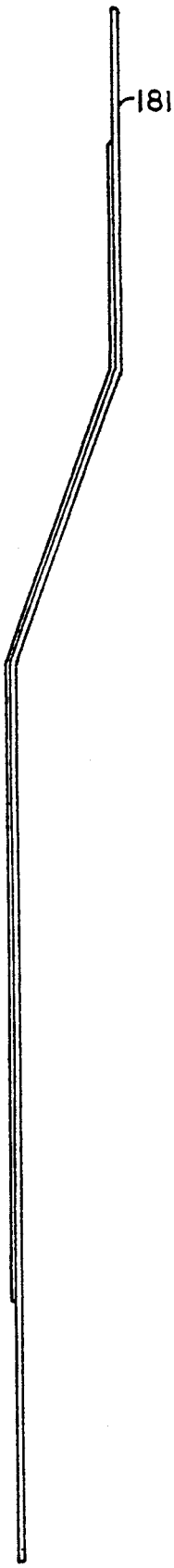
FIG. 22 is a side elevational view of the cam arm.
Figure 21:
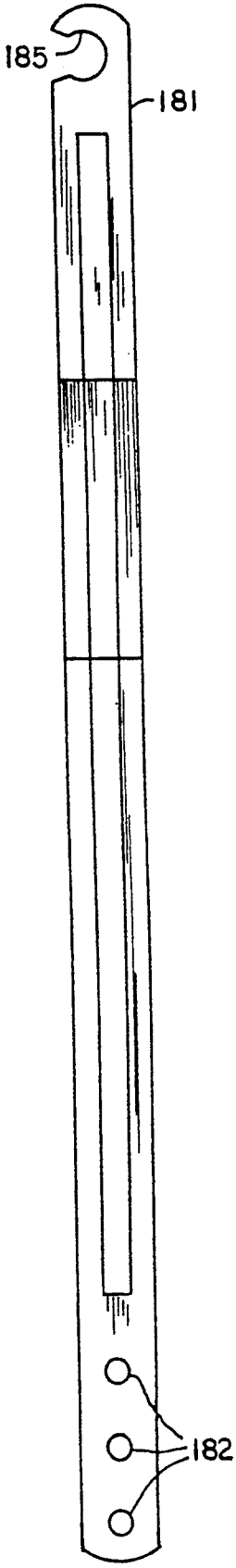
FIG. 21 is a plan view of a cam arm.
Figure 26:
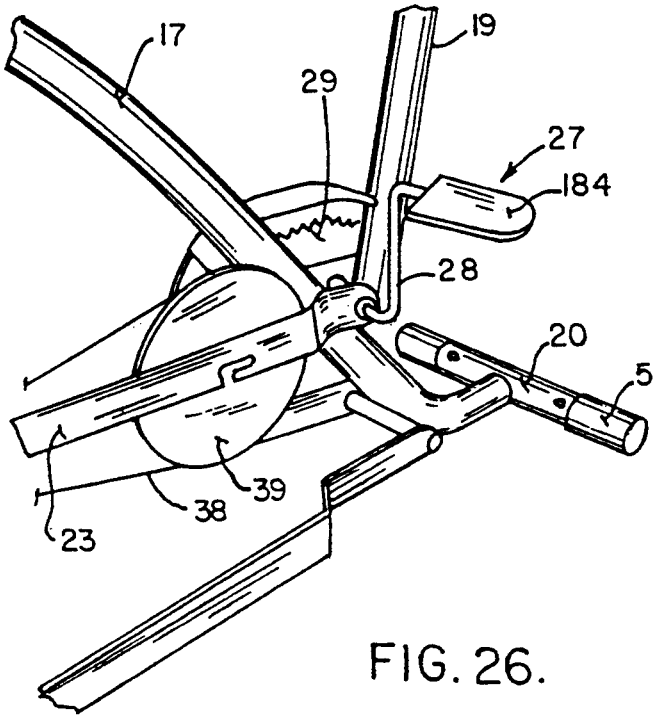
FIG. 26 is a somewhat diagrammatic view illustrating a drive train, and handlebar reciprocating mechanism.

Left attachment plate 51 is an annular wall or ring. Ring 51 (FIGS. 9–11) has a radial planar surface around a central opening 57. The planar surface has an inner face 59 and an outer face 61. Inner face 59 has a plurality of ribs 63 extending radially from opening 57. Ribs 63, like ribs 41, are evenly spaced around ring 51 and are formed in pairs. A concentric rib 65 extends around ring 51 near the outer periphery of inner face 59. Outer face 61 has three concentric ribs 67, 68, and 69. Rib 67 is at the inner edge of ring 51 and forms an inner wall 71. Ribs 68 and 69 are spaced radially outwardly from rib 67. A plurality of bolt holes 73, having chambers 74, are evenly spaced around ring 51 on the circle formed by rib 69. Bolt holes in the bottom of bolt-receiving wells 73 are formed similarly to bolt holes 43 of disc 37, but are configured to permit turning of a bolt head. Chambers 74 of ring 51 face inwardly toward plate 33. Ring 51 is secured to plate 33 by through bolts 7 which extend through wheel 36 to secure ring 51 and plate 33 to wheel 36. The side plates 51 and 33 are positioned so that vanes 151 of wheel 36 fit in the channels formed by the rib pairs of rings 51 and plate 33, and the through bolts are tightened so that ring 51 and plate 33 are tight against wheel 36 so that wheel 36, ring 51 and plate 33 will rotate about axle 25 together.

A cowling assembly 35 is secured at one side to tine 10*b*. Cowling assembly 35 (FIGS. 4, 5 and 8–17) includes a housing 53 and a damper 55.

Housing 53 (FIGS. 5 and 12–14) includes a generally planar disc 81 with a central opening 83. Disc 81 is slightly larger than ring opening 57. Disc 81 has three intake openings 85 formed therein, one of which has an arcuate key slot 87 extending from an edge thereof. Three radially extending ribs 89 are positioned between intake openings 85 on the inboard side of disc 81. An annular wall 91 extends around the periphery of the disc 81 axially inwardly. A flange 93 extends radially outwardly from about the axial middle of wall 91 and a second annular wall 95 extends axially inwardly from the edge of flange 93. The facing surfaces of walls 91 and 95 are co-axial, and joined by an inner surface of the flange 93. Walls 91 and 95 and flange 93 form an annular channel 97 around the periphery of disc 81.

An inner, axially projecting wall 99 extends around opening 83. Wall 99 extends both inwardly and outwardly from disc 81. A lip 101 extends inwardly from the outer edge of wall 99 to define the mouth of opening 83.

Elongated channels 103 shaped complementarily t tine 10*b* are formed in extensions 105*a* and 105*b* at the periphery of housing 53. Channels 103 are aligned and are chordal with respect to the center of disc 81. Another extension 107 forms a rectangular channel 109 oriented substantially perpendicularly to channel 103. Extensions 105*a* and 105*b* have bolt holes 108 to connect the housing to fork tine 10*b* and extension 107 has similar bolt holes to connect the housing to one of the mounting bars 23 Extensions 105*a* and 105*b* embrace fork tine 10*b* and extension 107 embraces one of the mounting bars 23.

Damper 55 (FIGS. 14–16) includes a planar disc 111 equal in size to housing disc 81, and has openings 113 equal in size to intake openings 85 and solid areas 115 which are large enough to cover intake openings 85. A cylindrical wall 117, slightly larger in inner diameter than housing wall 99, extends axially outwardly from the center of disc 111. A lip 119 defining a central opening 121 extends radially inwardly from the outer edge of wall 117. Four openings 123 are formed in lip 119. Fingers 125 extend inwardly from the lip 119 at the radially inner edges of openings 123. The radially outer surfaces of fingers 125 have locking wedges 127 at their axially inboard ends which slope axially upwardly and radially outwardly toward lip 119 and wall 117 and end with shoulders 129.

A right triangular wall 131 formed on one of solid areas 115 extends chordally with respect to the opening 121 and axially inwardly from the inner surface of disc 111. Along its vertical edge triangular wall 131 has a circular boss 133.

Figures 4, 5, 6, 7, 8:
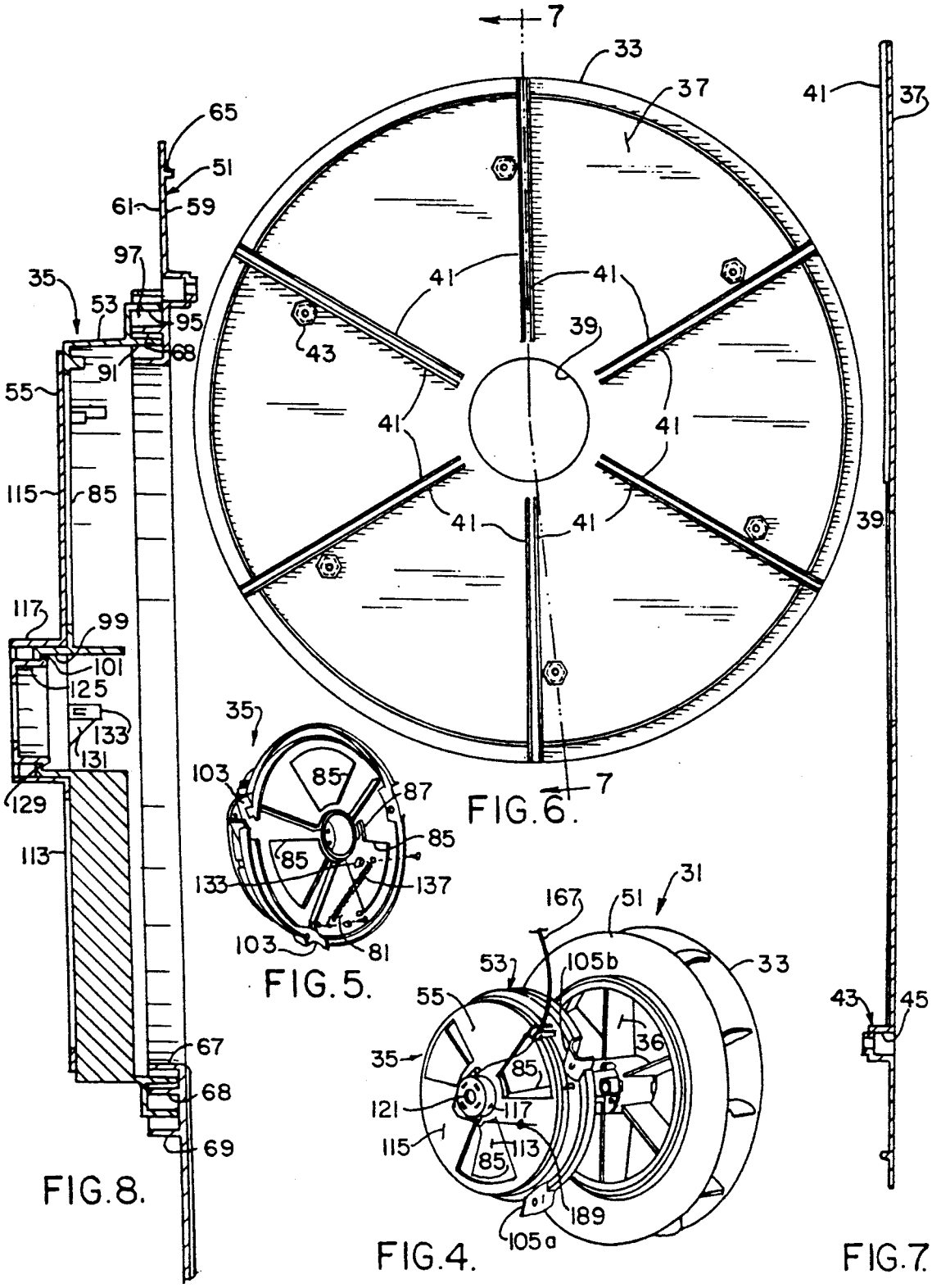
FIG. 4 is an exploded view of a wheel assembly of the exercise bicycle, reduced in scale as compared to FIG. 3.
FIG. 5 is a rear perspective view of a intake assembly of the wheel assembly.
FIG. 6 is a plan view of a plate of the wheel assembly.
FIG. 7 is an enlarged, cross-sectional view of the plate taken along line 7—7 of FIG. 6.
FIG. 8 is a cross sectional view of a intake assembly of the wheel assembly.

The manner in which housing 53 and damper 55 fit together and coact with ring 51 can be seen in FIG. 8. Housing 53 is mounted to the outside of tine 10*b* so that its walls 91 and 95 sandwich rib 68 of ring 51, rib 68 of the ring 51 being received in channel 97 formed by walls 91 and 95. The interaction of walls 91 and 93 with ribs 67, 68, and 69 creates a labyrinth seal between housing 53 and ring 51. The seal is close but the spaces between the ribs are sufficient so that ring 51 can rotate without any impedance from housing 53. Damper 55 is rotatably mounted on housing 53. Finger shoulders 127 engage lip 101 of intake wall 99 to hold it thereto. Vent wall 99 is thus sandwiched between fingers 125 and damper wall 117. Damper 55 can then be rotated between a position in which intake openings 85 are opened (damper openings 113 are over intake openings 85) and in which the intake openings are closed (damper solid areas 115 are over intake openings 85).

Damper boss 133 rides in housing key slot 87 and engages the closed end of housing key slot 87. Key slot 87 thus limits the rotation of damper 55 relative to intake 53. It allows for the damper to move between a position in which the intake openings are fully opened and a position in which the intake openings are fully closed and anywhere in between. The rotation may be stopped at any point along the path so that the intake openings are only partially opened. A spring 137 is attached at one end to boss 133 by screws or the like which are received in boss 133 and at another end to the inside of housing disc 81. Spring 137 acts to bias the intake assembly toward a normally open position.

Figure 3:
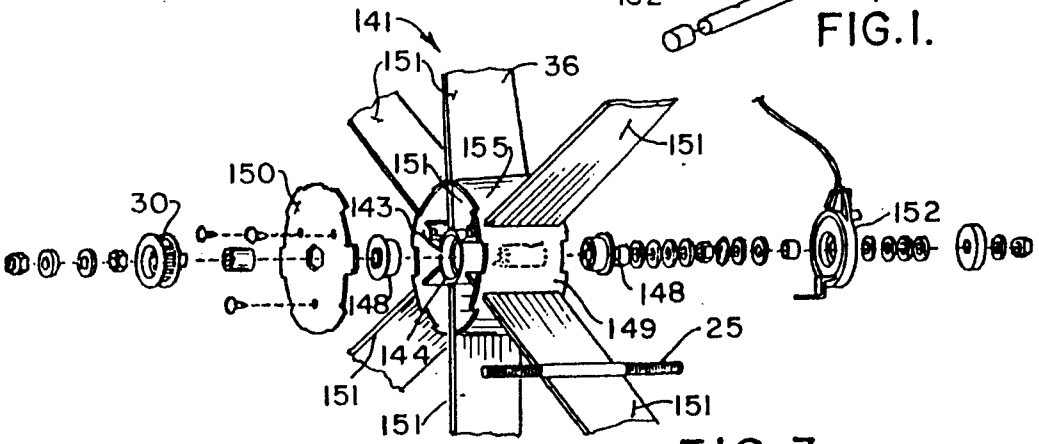
FIG. 3 is an enlarged, exploded view of a hub assembly of a fan wheel of the exercise cycle.

A fan wheel 141 (FIGS. 3, 18–20) is mounted on axle 25, between plate 33 and the ring 51. Fan wheel 141 has a hub portion 143 having a hub 144 by Which the fan Wheel 141 is mounted on axle 25. Hub 144 has a step 147 at either end. A bearing retainer 148 fits in hub 144 and has a shoulder which engages hub step 147. Axle 25 extends through bushing 148 rotatably to mount wheel 141 between mounting bars 23. As can be seen in FIGS. 2 and 3, axle 25 has threaded ends and is secured to the bars with nuts, washers and spacers. One side of hub 144 is covered by a plate 150, the other side receives a speed pick up 152, by which the speed at which wheel 144 is rotating is determined and displayed.

A concentric wall 149 is attached to hub 144 by spokes 151 which extend radially from hub 144. Spokes 151 intersect and extend radially from hub 144, intersecting wall 149. Blind holes 155 are formed on spokes 151 between hub 144 and wall 149 to secure plate 150 thereto. Speed pick up 152 has an arm which engages the vanes between hub 144 and wall 149 as the fan wheel rotates to determine its rotational speed, as is known in the art. The through bolts 76 which connect ring 51 and plate 33 extend through the area between the vanes of the fan wheel.

An outer wall 157, concentric with wall 149, extends around wheel 141 near the ends of vanes 153. In cross-section, wall 157 has a center ring 159, a rib 161 at an axially inner end thereof, and a rib 163 near an axially outer end thereof. A plurality of curved paddles 165 are secured to outer wall 157.

In operation, as wheel 141 is rotated on axle 25, paddles 165 and vanes 151 pull air in through intake 53 to be forced out along the periphery of the fan wheel. It thus acts like a centrifugal blower. By opening or closing the intake openings, the amount of air that is pulled in is varied, thereby changing the amount of resistance necessary to overcome to make the wheel rotate at a specific rotational speed. The resistance of the wheel to air can in this way be altered without the need to alter the rotational velocity of the wheel. As seen in FIG. 1, the wheel assembly can be enclosed by side vented walls 171 and a circular vented outer wall 173.

Damper 155 can be opened and closed by using a bowden wire 167 which is connected to a block 189 on the outer surface of damper disc 111 at one end and to a lever 190 at another. As is known, by moving the lever, the wire is extended or retracted to rotate the damper to open or close the intake. Alternatively, the opening and closing of the intake can be electronically controlled. In such a control system, the device could be programmed to increase and decrease the resistance.

Turning to FIGS. 21–25, cam arms 181, only one of which is illustrated, are pivotally connected to the bottom of the handlebar posts 15. Each arm 181 has three holes 182 at one end thereof. A bushing 184 is used to connect arm 181 to post 15 through one of the holes 182. Holes 182 at the forward end of arm 181 allow handlebar posts 15 to be set at a selected angle to the vertical. At an end remote from posts 15, cam arm 181 is removably connected to a shaft 183 extending between the crank shaft 28 of crank assembly 27 and a pedal 184. Shaft 183 rotatably connects pedals 184 to crank 28. Cam arm 181 has a modified keyhole cutout 185 formed at one end which fits over an outwardly stepped part of shaft 183. As the pedal is rotated, shaft 183 rotates in cutout 185, moving the cam arm forward and backward, thereby moving the handlebars between their forward and rearward positions 180° out of phase. Arm 181 is installed over a reduced portion of the shaft and is held onto the outwardly stepped part of the shaft 183 by a sponge rubber spring 187 which urges arm 181 against a washer 189 at shaft 183. A second washer 191 holds spring 187 in place.

Each arm 181 may be removed from pedal shaft 183 and connected to a cam arm holder 195 so that the handlebar associated with that arm will not reciprocate. Holder 195 has a shoulder 197 at its end and a sponge rubber spring 199 butting against another, axially inboard shoulder to bias the arm against the shoulder 197 to maintain arm 181 on holder 195 during operation of the cycle 1.

To remove arm 187 from pedal shaft 183, the arm is urged inwardly, compressing spring 187 to clear the outwardly stepped part. The arm can then be removed from shaft 183. To place it on holder 195, arm cutout 185 is placed adjacent the end of spring 199 and is used to compress the spring to expose the holder 195. The arm 181 can then be placed on the holder. To return the arm to the pedal shaft, the same procedures are followed in reverse.

Numerous variations in the construction of the device, within the scope of the appended claims, will be apparent to those skilled in the art in light of the foregoing description and accompanying drawings. For example, the intake assembly could be differently constructed to have fewer parts. Ring 51 could be constructed as a plate having intake holes therein. Damper 33 could then be mounted to the annular plate. Such an assembly would obviate (or eliminate) the need for a separate intake piece, such as intake 53. The opening and closing of the damper could be electronically rather than manually controlled. Such control would allow for programming of a workout. The handlebars can be interconnected and reciprocated together with a single cam arm. A different type of compression spring from the sponge rubber can be used. These examples are merely illustrative.

Having thus described the invention, what is claimed and desired to be secured by Letters Patent is:

1. An exercise cycle comprising:

a stand;

a wheel assembly mounted on said stand, said wheel assembly including a fan wheel acting as a centrifugal blower, drawing air, intermediate its radial reach and expelling it toward its periphery;

means operated by an operator for revolving said wheel;

damper means for varying the amount of air drawn by said wheel, hence varying the air resistance of said wheel at a given rotational speed; and a solid disc secured to one side of said fan wheel, said damper means being attached to a fixed element of said stand opposite said solid plate; said fan wheel being rotatably mounted on said axle between said disc and said damper means; said damper means comprising a cowling defining at least one intake opening, and means for varying the size of said opening.

2. The exercise cycle of claim 1 wherein said wheel assembly further includes an annular wall secured to said wheel opposite said solid disc; said cowling including housing means mounted over said ring, said housing means having a generally planar surface defining said at least one intake opening; said means for varying the size of said intake opening including a damper rotatably mounted on said cover, said damper having at least one solid area sufficiently large to fully close said intake, at least one opening to fully open said intake opening, and means for rotating said damper to move it between a fully open position and a fully closed position.

3. The exercise cycle of claim 2, said ring having an inner edge defining an inner wall, a first rib concentric with, and spaced from, said inner wall, and a second rib spaced from and concentric with said first rib; said housing having spaced concentric ribs defining a channel which receives said ring ribs; the interaction of said ring ribs and said cover ribs defining a labyrinth seal.

4. The exercise cycle of claim 3 wherein said housing further includes an inner edge defining a central opening, a wall extending outwardly from said inner wall, and a radially inwardly extending lip at a top edge of said wall; said damper further including spaced fingers arranged around a circle concentric with the center of said housing; said fingers having lips which engage said lip of said housing to rotatably mount said damper to said housing.

5. The exercise cycle of claim 4 wherein said fan wheel comprises a hub which is journaled over said axle, vanes extending radially from said hub, an outer wheel concentric with said hub attached to said vanes remote from said hub, and paddles extending arcuately outwardly from said outer wheel.

6. An exercise cycle comprising:

a stand;

a wheel assembly mounted on said stand, said wheel assembly including a fan wheel rotatably mounted on an axle, said fan wheel acting as a centrifugal blower, drawing air intermediate its radial reach and expelling it towards its periphery;

means operated by an operator for revolving said wheel including; a crankshaft having outwardly extending shafts with pedals on ends thereof, said crankshaft being operatively connected to said wheel;

damper means for varying the amount of air drawn by said wheel, hence varying the air resistance of said wheel at a given rotational speed;

a fork;

a head tube on said fork;

handle bar posts having handle bars at the tops thereof, said handle bar posts being pivotally connected to said head tube intermediate the ends of said posts;

means for switching said handle bars between a mode in which they reciprocate between a forward and a backward position while said pedals are rotated and a mode in which said handle bars are stationary while said pedals are rotated;

said mode switching means comprising a cam arm pivotally connected at one end to said handle bar post beneath its pivot point and removably connected at another end to said pedal shaft;

said cam arm including a cutout, said cutout being sufficiently large so that it may be removably placed over and pedal shaft, said pedal shaft including spring means to hold said cam arm on said pedal shaft.

7. The exercise cycle of claim 6 wherein said spring means includes a sponge rubber spring.

8. The exercise cycle of claim 6, said stand further including a fixed stand shaft which removably receives said cam arm when said cam arm is not attached to said pedal shaft.

9. The exercise cycle of claim 6 wherein said stand further includes a fixed stand shaft which removably receives said cam arm when said cam arm is not attached to said pedal shaft, and spring means to removably hold said cam arm thereon.

10. The exercise cycle of claim 9 wherein said holding shaft spring means comprises a sponge rubber spring.

11. An exercise cycle comprising:

a stand including a seat;

a fork having a head tube thereon;

a wheel assembly supported by said fork having a rotatable wheel;

a crankshaft having outwardly extending shafts with pedals on ends thereof, said crankshaft being operatively connected to said wheel;

handlebar posts having handlebars at the tops thereof, said handlebar posts being pivotally connected to said head tube between the bottom and top of said posts; and means for switching said handlebars between a mode in which they reciprocate between a forward and a backward position while said pedals are rotated and a mode in which said handlebars are stationary while said pedals are rotated;

said mode switching means comprising a cam arm pivotally connected at one end to said handlebar post beneath its pivot point and removably connected at another end to said pedal shaft;

said cam arm including a cutout, said cutout being sufficiently large so that it may be removably placed over said pedal shaft;

said pedal shaft including spring means to hold said cam arm on said pedal shaft, said spring means being mounted on said shaft opposite said pedal with respect to said cam shaft whereby said cam shaft is mounted between said spring means and said pedal.

12. The exercise cycle of claim 11 wherein said spring means includes a sponge rubber spring.

13. The exercise cycle of claim 11 wherein the stand further includes a fixed holding shaft which removably receives said cam arm when said cam arm is not attached to said pedal shaft.

14. The exercise cycle of claim 13 wherein said holding shaft includes spring means to removably hold said cam arm thereon.

15. The exercise cycle of claim 14 wherein said holding shaft spring means comprises a sponge rubber spring.

* * * * *